US006308351B1

(12) United States Patent
Franke

(10) Patent No.: US 6,308,351 B1
(45) Date of Patent: Oct. 30, 2001

(54) ELECTROMATIC POP UP DRAIN

(76) Inventor: Craig Robert Franke, 14427 Brook Hollow Blvd. #188, San Antonio, TX (US) 78232

( * ) Notice: Subject to any disclaimer, the term of this patent is extended or adjusted under 35 U.S.C. 154(b) by 0 days.

(21) Appl. No.: 09/460,807

(22) Filed: Dec. 14, 1999

(51) Int. Cl.[7] ..... E03C 1/23
(52) U.S. Cl. ..... 4/689; 4/690; 4/691; 4/693
(58) Field of Search ..... 4/689–693, 684, 4/685, 668, 295

(56) References Cited

U.S. PATENT DOCUMENTS 4,945,579 * 8/1990 Husting ..... 4/689
5,363,519 * 11/1994 Husting ..... 4/689

FOREIGN PATENT DOCUMENTS

4241023 * 6/1994 (DE) ..... 4/689
487215 A2 * 5/1992 (EP) ..... 4/689

* cited by examiner

*Primary Examiner*—Gregory L. Huson
*Assistant Examiner*—Tuan Nguyen

(57) ABSTRACT

An "Electromatic Pop Up Drain" for electronically raising and lowering the pop up drain plug in lavatory sinks. The "Electromatic Pop Up Drain" has infrared sensors as a triggering device, ac-dc electric motor as the actuating device, positioning and connective linkage. The user actuates the drain plug by passive hand motion detected by the infrared sensors. This detection device triggers a sequence of events that leads to the closing of the drain plug. A second detection of hand movement by the infrared sensors cause the drain plug to open allowing for the water or liquid to drain freely from the sink.

1 Claim, 1 Drawing Sheet

ELECTROMATIC POP UP DRAIN

CROSS REFERENCE TO RELATED APPLICATION

"Not Applicable"

STATEMENT REGARDING FEDERALLY SPONSORED RESEARCH AND DEVELOPMENT

"Not Applicable"

REFERENCE TO MICROFISCHE APPENDIX

"Not Applicable"

BACKGROUND OF THE INVENTION

Figure 1:
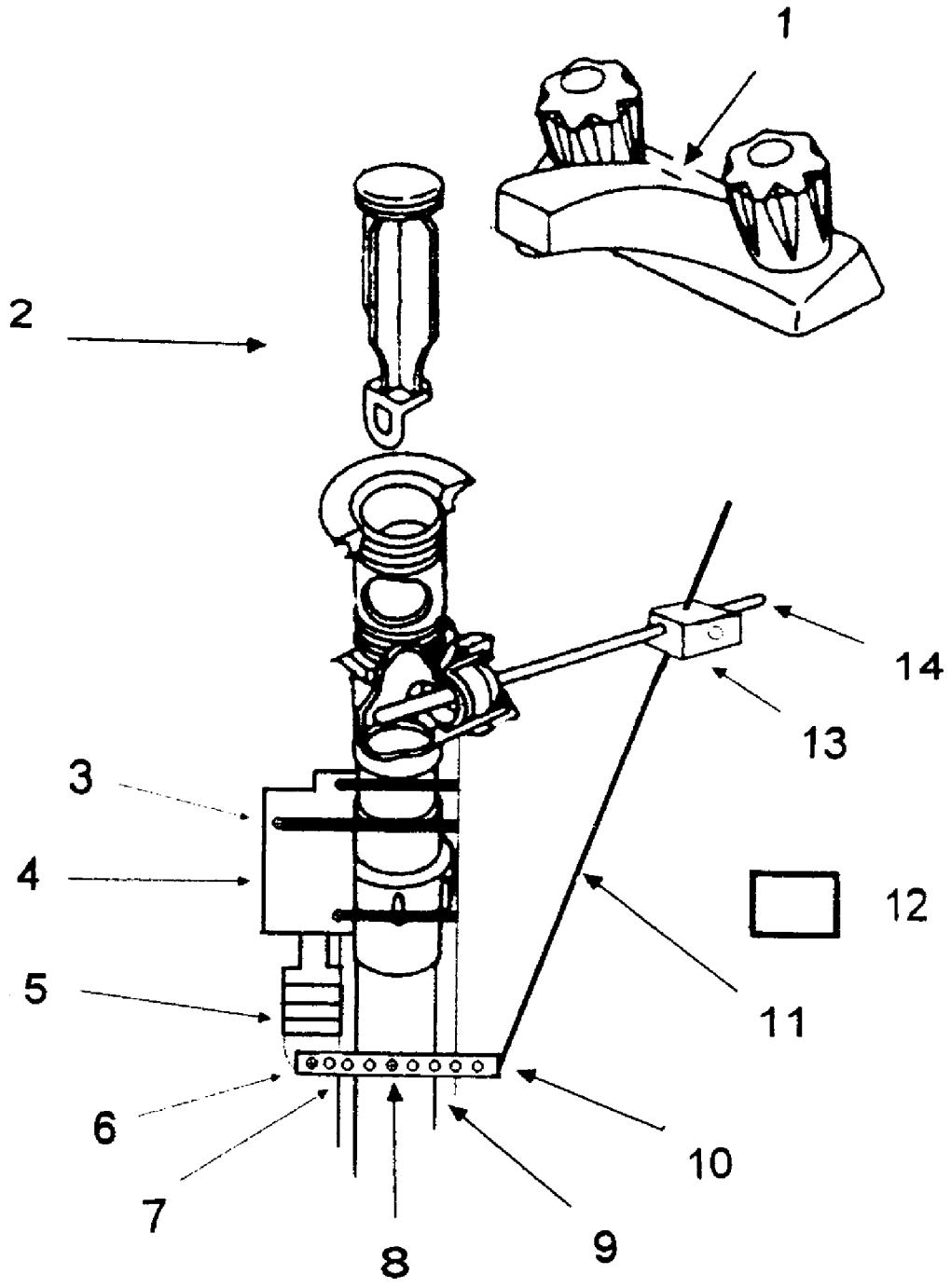

The "Electromatic Pop Up Drain" is an electrical mechanical device designed for use in the field of lavatory faucet applications. Ostensible designed for the purpose of electrically mechanically rising and lowering of the pop up drain plug in lavatory sinks. Typically, a metal lift rod & clevis assemble is employed to rise and lower a pop up drain plug on lavatory sinks. This practice of using a non electrical, manually operated lift rod & clevis assemble has been in use for more than 50 years, with out sophisticated improvement or technological advancement.

BRIEF SUMMARY OF THE INVENTION

The "Electromatic Pop Up Drain" replaces the need for a lift rod & clevis assemble found on conventional lavatory faucets with a motion sensing device that responds to the detection of passive hand movement. Once the motion sensing device detects the presence of passive hand movement an electrical pulse is transmitted to an electrical mechanical arm, via electrical circuit that in turn rises and lowers the pop up drain plug on lavatory sinks. A second detection of passive hand movement would have the opposite effect, of rising or lowering the pop up drain plug.

BRIEF DESCRIPTION OF DRAWINGS SEVERAL VIEWS

FIG. 1 depicts the "Electromatic Pop Up Drain"

DETAILED DESCRIPTION OF THE INVENTION

When a motion sensor located at FIG. 1 detects the presence of passive hand movement, an electrical pulse is transmitted to a circuit control box 12, circuit design "© 1999 Aquaista" (17 U.S.C. 401) causing the electronic actuator 4, secured by the moisture seal pad 9, and fastening stirrups 3, powered by an ad-dc electric motor of the same electronic arm 5, to either contract or expand. This contraction or expansion of the electronic arm connected to the pivot collar 7, creates a c-saw reaction effect at a center pivot point 8, and 6. A downward movement or expansion of the electronic arm causes to create an equal and opposite reaction upon the position of the push rod 11. A downward movement or expansion of the electronic arm 5, forces to cause the push rod to shift to a higher position over the center pivot point 8. The mechanism used to provide a pivot point between the pivot collar 7, and the push rod 11, is a rubber grommet insert 10. As downward force is applied to the pivot collar 7, a rising effect gives way to the push rod 11, causing the pivot rod 14, to rise, and the pop up drain plug 2, to lower, or close. An equal and opposite reaction by the electronic arm 5, has the effect of rising or opening the pop up drain plug 2. The adjustable yoke 13, is the mechanism connecting the push rod 11, and the pivot rod 14. The yoke is adjustable and may slide vertical on the pivot rod and horizontally on the push rod for accurate adjustments, Accurate adjustment of the yoke 13, is necessary to insure the lavation effect of the expanding arm is applied to said pivot points as to cause the rise and fall of the pop up drain plug 2.

I claim:

1. An electromatic pop up drain assembly for lavatory sinks having a pop up drain plug, the assembly consisting primarily of:

an infrared sensor act as a signal triggering device, which maybe situated in the proximity of, or on a lavatory faucet;

a ac-dc electric motor actuator;

a pivot collar, movable in a c-saw fashion in response to the action of said electric motor;

a push rod in response to the action of said pivot collar by the thrust applied from said electric motor;

a yoke connected to a pivot rod for raising and lowering the pop up drain plug in response to the forces applied from said push rod through said pivot collar emanated from said electric motor triggered by said infrared sensor.

* * * * *